United States Patent [19]

Igarashi et al.

[11] Patent Number: 4,767,282

[45] Date of Patent: Aug. 30, 1988

[54] FLUID PRESSURE BOOSTER

[75] Inventors: Tadashi Igarashi; Mikio Yamaji; Naotake Oneyama, all of Soka, Japan

[73] Assignee: Shoketsu Kinzoku Kogyo Kabushiki Kaisha, Tokyo, Japan

[21] Appl. No.: 55,304

[22] Filed: May 29, 1987

Related U.S. Application Data

[60] Division of Ser. No. 912,189, Sep. 25, 1986, Pat. No. 4,674,958, which is a continuation of Ser. No. 751,531, Jul. 3, 1985, abandoned.

[30] Foreign Application Priority Data

Aug. 2, 1984 [JP] Japan ..... 59-119912
Dec. 18, 1984 [JP] Japan ..... 59-191891

[51] Int. Cl.[4] ..... F04B 17/00

[52] U.S. Cl. ..... 417/225; 417/393; 91/329; 91/341 A; 91/350

[58] Field of Search ..... 417/225, 393, 538; 91/341 A, 329, 348, 350

[56] References Cited

U.S. PATENT DOCUMENTS 1,453,561 5/1923 Willshaw ..... 417/393
1,839,540 1/1932 Farr ..... 91/329
2,702,006 2/1955 Bachert ..... 91/350 X
2,925,782 2/1960 Sharpe et al. ..... 91/348 X
2,977,040 3/1961 Dulebohn et al. ..... 417/393 X
3,402,642 9/1968 Van Hecke et al. ..... 91/329

FOREIGN PATENT DOCUMENTS 325269 9/1920 Fed. Rep. of Germany ..... 91/329

*Primary Examiner*—Leonard E. Smith
*Attorney, Agent, or Firm*—Oblon, Fisher, Spivak, McClelland & Maier

[57] ABSTRACT

There is described a fluid pressure booster including a pair of cylinders connected to the opposite sides of a central partition wall of a casing with an inlet port, an outlet port and air exhaust ports, a pair of pistons reciprocable in the cylinders and defining a boosting chamber and a drive chamber in each cylinder, and a switch valve adapted to supply a line air pressure alternately to the drive chambers of the two cylinders, thereby reciprocating the pistons to intensify the fluid pressure in the boosting chambers. The switch valve of the booster is provided with a spool stall preventive means which is arranged to suppress the pressing force on the valve body of the switch valve with the fluid pressure or biasing action of a spring until the valve body reaches the neutral position thereof and to encourage the pressing action on the valve body with a biasing force after reaching the neutral position to prevent stalls of the valve body at that position.

7 Claims, 4 Drawing Sheets

FLUID PRESSURE BOOSTER

This is a division of application Ser. No. 912,189 filed Sept. 25, 1986, now U.S. Pat. No. 4,674,958, which is a continuation of application Ser. No. 751,531, filed July 3, 1985, now abandoned.

BACKGROUND OF THE INVENTION

1. Field of the Invention

This invention relates to a booster for elevating the pressure level of a pressurized fluid to be supplied to a load through pipings or the like.

2. Description of the Prior Art

Various pneumatically operating units in a plant or factory usually receive a supply of compressed air from a common pressurized air source through pipings. In a case where one or some of the units require supply of compressed air of a higher pressure level than the source pressure or in a case where the pressure of compressed air unavoidably drops before reaching the end of the pipings, it is necessary to install further pressurized air sources or intensify the air pressure in the pipings by means of a booster or the like.

The present invention previously proposed a booster suitable for use in such a case, which is adapted to elevate the air pressure by the use of line air pressure in the pipings alone without necessitating power supply from outside. As a result of further studies and pilot operations, this previously proposed booster turned out to have still a number of problems as follows.

As diagrammatically shown in FIG. 1, the booster is provided with a pair of coaxial cylinders 5*a* and 5*b* on opposite sides of a center partition wall 4 of a casing 1 with inlet and outlet ports 2 and 3. Pistons 6*a* and 6*b* which are fitted in the cylinders 5*a* and 5*b* are connected with each other by a rod 7 which is hermitically passed through the partition wall 4. The boosting chambers 9*a* and 9*b* which are respectively defined in the cylinders 5*a* and 5*b* on the opposite sides of the center partition wall 4 by the pistons 6*a* and 6*b* are communicated with the inlet port 2 through inlet check valves 11*a* and 11*b* which permit only air flows into the boosting chambers and with the outlet port 3 through outlet check valves 12*a* and 12*b* which permit only air flows out of the boosting chambers. A switch valve 13 which communicates drive chambers 10*a* and 10*b* in the cylinders 5*a* and 5*b* alternately with the inlet port 2 and an exhaust ports 17*a* or 17*b* is provided in the partition wall 4, push rods 18*a* and 18*b* of the switch valve being protruded into the boosting chambers 9*a* and 9*b*, respectively, to switch the position of the switch valve 13 alternately by pushing actions of the pistons 6*a* and 6*b*.

In FIG. 1, indicated at 15 is a pressure regulator valve which regulates the pressure to be supplied to the drive chambers 10*a* and 10*b*.

With the booster of the above-described construction, the air pressure from the inlet port 2 is constantly drawn into the boosting chambers 9*a* and 9*b* through the inlet check valves 11*a* and 11*b*, and, when the switch valve 13 is pushed rightward by the pushing action of the piston 6*b* of the left cylinder as shown in FIG. 1, the pressurized air from the pressure regulator valve 15 is fed to the right drive chamber 10*a* through the switch valve 13 while releasing the left drive chamber 10*b* to the atmosphere. Accordingly, the pistons 6*a* and 6*b* are driven leftward by the fluid pressure in the drive chamber 10*a*, boosting the air pressure in the boosting chamber 9*a* for supply through the outlet port 3. As soon as the piston 6*a* comes to its stroke end, pushing the push rod 18*a* to change the position of the switch valve 13, the above-described operation is reversed to intensify the pressure in the boosting chamber 9*b*.

The booster of this sort can shift the position of the switch valve 13 by the reciprocating movements of the pistons without troubles as long as the pistons are in high-speed operation. However, when the secondary pressure reaches a predetermined level due to reduced consumption threeof or when the driving speed of the pistons is lowered due to a drop in supply pressure, there may arise a difficult situation that the pistons which have once come to a stop would not re-start due to malfunctioning of the switch valve.

Our study in this respect revealed that, if the pushing force of the pistons is lowered due to a drop in the supply pressure or by other reason when the switch valve is shifted near to its neutral position, the switch valve which is now free of the switching action of the pistons stalls at the neutral position. Consequently, even if the supply air pressure is inceased again, the switch valve remains in the neutral position without restarting since the pressurized air is supplied to neither one of the drive chambers through the switch valve.

More particularly, the failure of re-start takes place, for example, when the piston 6*a* of FIG. 1 under influence of a dropped fluid pressure pushes the spool of the switch valve 13 to an intermediate position to switch the charging and discharging of the drive chambers 10*a* and 10*b*. At this time, the piston 6*a* is slided in an opposite direction (to the right in FIG. 1) by a reversed small operating force. However, in a case where a differential type check valve having no springs is used for the inlet check valve, the charging and discharging of the drive chambers 10*a* and 10*b* are not yet sufficient at a time point soon after switching of the spool, so that a pressure differential sufficient for closing the inlet check valve 11*b* is not yet produced in the boosting chamber 9*b* by rightward slide of the pistons 6*a* and 6*b*. As a consequence, the inlet check valve 11*b* remains open, and no pressure is produced in the boosting chamber 9*b*.

Accordingly, the pistons 6*a* and 6*b* are slided by inertia force even when there is almost no working fluid pressure in the drive chamber 10*b*, slightly sliding the spool of the switch valve 13 through the push rod 18*b*. As a result, the switch valve 13 stops at the neutral position in some cases, failing to re-start as the fluid pressure is not supplied to the drive chambers 10*a* and 10*b* even after the line air pressure is restored.

OBJECTS OF THE INVENTION

It is an object of the present invention to prevent the spool of the switch valve from stalling at a neutral position in the booster of the type mentioned above, precluding the re-start failures.

It is a more particular object of the invention to provide a booster which is provided with means for applying a gradually increasing resistance to pistons of the booster before the spool of a switch valve reaches its neutral position to lessen their pressing effort on the spool of the switch valve and/or means for encouraging the driving force on the spool upon reaching the neutral position, thereby to prevent the spool from stopping dead at the neutral position without re-starting.

It is another object of the invention to provide a booster which is provided with means for positively driving the spool of a switch valve to prevent its stalling at a neutral position and eliminating the causes of the spool stalling thereby precluding the re-start failures.

SUMMARY OF THE INVENTION

According to the invention, the above-mentioned objectives are achieved by the provision of a fluid pressure booster which comprises: a switch valve having a stall preventive means which prevent a spool of the switch valve from stalling at a neutral position thereof by suppressing the spool switching force before reaching that position or encouraging the switching action after reaching that position with the fluid pressure or a biasing spring action before and/or after that position.

With the booster of the above-described arrangement, as the spool is slided by the pressing effort of the pistons acting through a push rod, the pressing force is suppressed until the spool reaches its neutral position and it is encouraged past that position. Therefore, the neutral position becomes as instable point of the switching action, urging the spool constantly toward more stable switched positions at its stroke ends. As a result, there is no possibility of the spool failing to re-start upon supplying the line air pressure.

The above and other objects, features and advantages of the invention will become apparent from the following description and the appended claims, taken in conjunction with the accompanying drawings which show by way of example some preferred embodiments of the invention.

DESCRIPTION OF THE PREFERRED EMBODIMENTS

Figure 2:
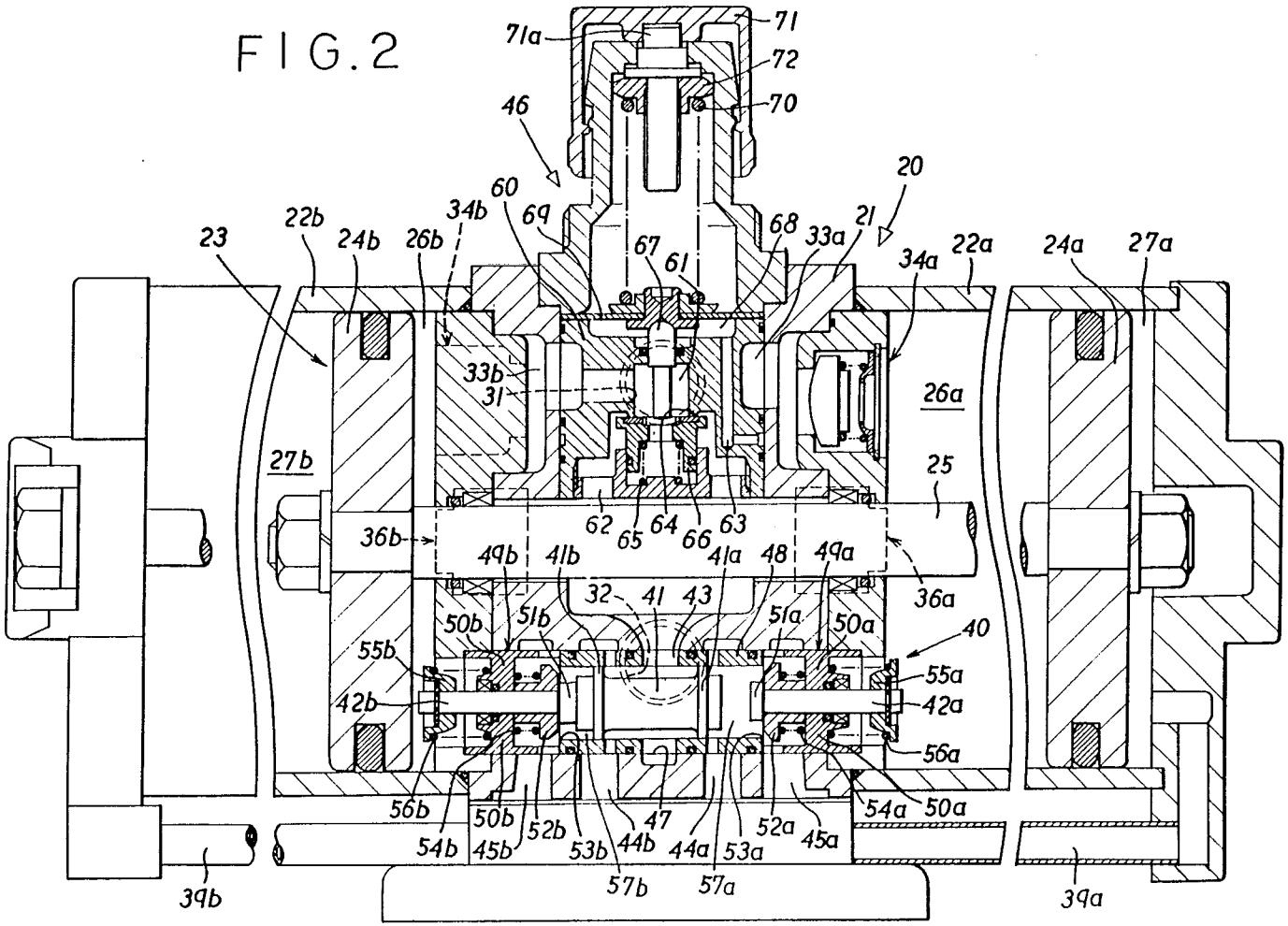
FIG. 2 is a vertically sectioned front view of a fluid pressure booster embodying the present invention.

The booster of the invention is hereafter described more particularly by way of the preferred embodiments shown in FIG. 2 and onwards.

Figure 1:
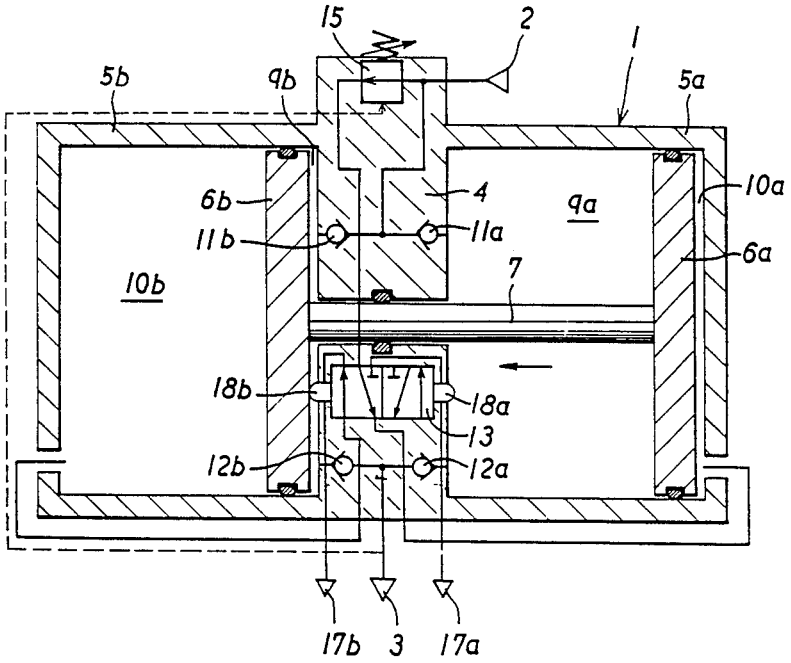
FIG. 1 is a schematic longitudinal section showing general construction of a conventional booster.

Illustrated in FIG. 2 are the details of a first embodiment of the booster according to the invention, which is substantially the same as the booster of FIG. 1 in general construction and efffect.

Namely, the booster includes a casing 20 having a pair of coaxial cylinders 22*a* and 22*b* on the opposite sides of a central partition wall 21, and a piston assembly 23 being formed by pistons 24*a* and 24*b* slidably fitted in the respective cylinders 22*a* and 22*b* and a shaft 25 which is hermetically passed through the central partition wall 21 and connecting said pistons each other. By these pistons 24*a*, 24*b* to 24*a* and 24*b*, boosting chambers 26*a* and 26*b* are defined in the cylinders 22*a* and 22*b* on the side of the central partition wall 21, respectively, and drive chambers 27*a* and 27*b* on the opposite side thereof.

The central partition wall 21 of the casing 20 is provided with inlet and output ports 31 and 32. The inlet port 31 communicates with the boosting chambers 26*a* and 26*b* in the cylinders 22*a* and 22*b* through inlet passages 33*a* and 33*b* with inlet check valves 34*a* and 34*b*, respectively, which permit fluid flows into the boosting chambers 26*a* and 26*b* only. The output port 32 communicates with the boosting chambers 26*a* and 26*b* through outlet passages (not shown) with outlet check valves 36*a* and 36*b* which permit fluid flows out of the boosting chambers 26*a* and 26*b* only.

A switch valve 40 is provided in the central partition wall 21 of the casing 20. It includes a spool 41 and push rods 42*a* and 42*b* which are protruded from the opposite sides of the partition wall 21 into the boosting chambers 26*a* and 26*b* of the cylinders 22*a* and 22*b*, respectively. The pistons 24*a* and 24*b* push the push rods 42*a* and 42*b* alternately to switch the position of the spool 41. Thereby, output ports 44*a* and 44*b* communicating with the drive chambers 27*a* and 27*b* of the cylinders 22*a* and 22*b* through external passage 39*a* and 39*b*, respectively, are alternately connected with a supply port 43, which is in communication with the inlet port 31 through a pressure regulator valve 46, and exhaust ports 45*a* and 45*b* which are opened to the atmosphere, to reverse the stroke of the pistons 24*a* and 24*b* upon reaching one stroke end.

More particularly, the switch valve 40 includes the centrally located supply port 43, output ports 44*a* and 44*b*, and exhaust ports 45*a* and 45*b* located symmetrically on the opposite sides of the supply port 43, all in communication with a bore 47 which extends through the casing 20. A sleeve 48 which is fitted in the bore 47 is provided with openings in communication with the supply port 43 and the output ports 44*a* and the 44*b*, and spool 41 with lands 41*a* and 41*b* is slidably fitted in the sleeve 48.

Cylindrical push rod guides 49*a* and 49*b* which are fitted in the bore 47 in such a manner as to close the opposite ends of the sleeve 48 are provided with partition walls 50*a* and 50*b* in which the push rods 42*a* and 42*b* are slidably fitted, and with openings in communication with the exhaust ports 45*a* and 45*b*. The push rods 42*a* and 42*b* are hermetically fitted in axial bores in the partition walls 50*a* and 50*b*, respectively, and have exhaust valves 52*a* and 52*b* slidably fitted thereon at positions inward of the partition walls 50*a* and 50*b* and in abutting engagement with stopper heads 51*a* and 51*b* at the inner ends of the respective push rods 42*a*, 42*b*. Bias springs 54*a* and 54*b* are interposed between the exhaust valves 52*a* and 52*b* and the partition walls 50*a* and 50*b*, urging the exhaust valves toward valve 52*a* and 52*b* seats 53*a* and 53*b* which are formed at the ends of the sleeve 48. In cooperation with associated parts, these exhaust valves 52*a* and 52*b* and valve seats 53*a* and 53*b* constitute a means for preventing standing of the spool 41 at the neutral position.

Travel springs 56*a* and 56*b* are interposed between spring seats 55*a* and 55*b* fixed at the outer ends of the push rods 42*a* and 42*b* and the partition walls 50*a* and 50*b*, respectively. The travel springs 56*a* and 56*b* have a slightly greater spring force than the bias springs 54*a* and 54*b*, and they therefore normally urge the exhaust valves 52*a* and 52*b* away from the valve seats 53*a* and 53*b*.

The pressure regulator valve 46 which is built in the central partition wall 21 of the casing 20 includes a valve casing 60 which is provided with an inlet port 61, an outlet port 62, a feedback port 63. and the inlet port 61 is communication with the inlet port 31 of the casing 20, the outlet port 62 is in communication with the supply port 43 of the switch valve 40, and the feedback port 63 is in communication with the outlet port 32 of the casing 20 through a fluid passage which is not shown, The inlet and outlet ports 61 and 62 of the valve casing 60 are communicable with each other through a valve seat 64 which is formed in the valve casing 60. The valve seat 64 is opened and closed by a valve body 66 which is biased by a valve spring 65. A valve stem 67 which is formed integrally with the valve body 66 is protruded into a feedback chamber 68 which is in communication with the feedback port 63. The valve stem 67, the fore end of which is in contact with a diaphragm 69, is pushed according to a balance between the biasing force of the secondary pressure regulator spring 70 acting upon the upper side of the diaphragm 69, which defines the feedback chamber 68, and the fluid pressure in the feedback chamber 68 acting on the lower side of the diaphragm 69, opening and closing valve seat 64 according to the difference between these biasing forces. The secondary biasing force of the pressure regulator spring 70 is adjustable by providing a screw rod 71*a* in a cap 71, The cap 71 is rotatably mounted on the valve casing 60 in such a manner that a nut 72 which serves as a seat for the secondary pressure regulator spring 70 is moved up and down by turning the cap 71.

Accordingly, when the secondary pressure at the outlet port 32 is below a preset level which is determined by the secondary pressure regulator spring 70, the pressure in the feedback chamber 68 is in low state, so that the pressure to be supplied from the inlet port 61 to the outlet port 62 is regulated through the valve seat, but the valve 64 remains open. On the contrary, when the biasing force of the fluid pressure in the feedback chamber 68 is greater, the valve stem 67 is moved upward to close the valve seat 64 with the valve body 66, which is biased by the valve spring 65, lowering the secondary pressure at the outlet port 32 to the preset level.

Instead of applying the biasing force of the secondary pressure regulator spring 70 on the upper side of the diaphragm 69, arrangements may be made such that a pilot fluid pressure for setting the secondary pressure is externally drawn into a space defined above the diaphragm 69. In this instance, the supply pressure to the booster is available as said pilot fluid pressure by making the effective area of the upper surface of the diaphragm 69 substantially double to that of the under surface thereof, because the output pressure of the booster are boosted within the limits of double of the supply pressure.

Turning now to the operation of the switch valve, when the spool 41 is in the position shown in FIG. 2, the air pressure flows from the supply port 43 to the output port 44*b*, blocking the communication between the exhaust port 45*b* and the output port 44*b* by the land 41*b*. The air pressure from the output port 44*a* is released to the atmosphere through the clearance between the exhaust valve 52*a* and the valve seat 53*a* and through the exhaust port 45*a*.

In this state, the pressurized air at the output port 44*b* flows into the left drive chamber 27*b* through the external passage 39*b* to push the piston 24*b* rightward, so that the operating force of the piston 24*b* is applied to the push rod 42*b* at the stroke end to move the push rod 42*b* rightward against the action of the travel spring 56*b*, pushing the spool 41 rightward with the stopper head 51*b*. Consequently, the exhaust valve 52*b* is abutted against the valve seat 53*b* by the action of the bias spring 54*b*.

If the spool 41 reaches substantially a neutral position by the above-mentioned rightward movement, the exhaust air from the output port 44*b* flows into a space 57*b* between the exhaust valve 52*b* and the land 41*b* and acts on the end face of the spool 41, in superposition on the operating force of the piston, to encourage the movement of the spool 41. Therefore, the spool 41 is slided beyond the neutral point without stalling thereat, to switch the flow passages.

In this instance, when the air pressure to the space 57*b* is at a high level, it opens the exhaust valve 52*b* against the action of the bias spring 54*b*. Thus, the pressure in the space 57*b* can be adjusted by the spring force of the bias spring 54*b*, so as not to be raised to an abnormal level.

Further, as the exhaust valve 52*a* is unseated from the valve seat 53*a* during the rightward movement of the spool 41, air in a space 57*a* between the exhaust valve 52*a* and the land 41*a* flows out through the exhaust port 45*a* and therefore has no possibility of hindering the movement of the spool 41 by occlusion in the space 57*a*.

As soon as the rightward movement of the spool 41 is completed by the flow of exhaust air into the space 57*b*, the communication between the output port 44*b* and the supply port 43 is blocked by the land 41*b*, while the communication between the output port 44*a* and the supply port 43 is established by the land 41*a*, thereby switching the flow passage of the pressurized air from the supply port 43 to the output port 44*a*. Then, if the operating force of the piston 24*b* is removed, the push rod 42*b* is moved leftward by the action of the travel spring 56*b* and the exhaust air pressure in the space 57*b*, unseating the exhaust valve 52*b* from the valve seat 53*b* to release the exhaust air from the output port 44*b* to the atmosphere through the exhaust port 45*b*.

If leftward movement of the piston assembly 23 is initiated by the above-described shift of the switch valve 40 to impose the operating force of the piston 24*a* on the push rod 42*a*, the above-described operation is performed in a reversed fashion, and the piston assembly returns to the position of FIG. 2, thereafter repeating the same boosting operation by reciprocating movements of the pistons 24*a*, 24*b*.

The secondary pressure which is produced at the output port 32 of the booster is set at an arbitrary level by the pressure regulator valve 46, and it is maintained at that level irrespective of variations in the load flow rate. Namely, the secondary pressure at the output port 32 which is returned to the feedback port 63 serves to raise or lower the output pressure of the pressure regulator valve 46 according to variations in the secondary pressure, thereby adjusting the pressure level of the compressed air to be supplied to the drive chambers 27*a*, 27*b* and maintaining the secondary pressure at a preset level.

Figure 3:
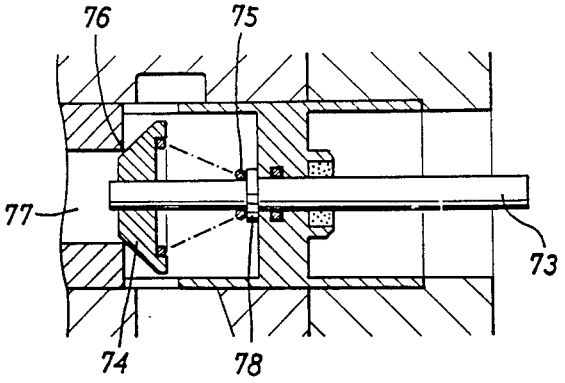
FIG. 3 is a fragmentary sectional view of said embodiment, but partly modified in a switch valve construction.

Although the exhaust valves 52*a* and 52*b* which are abutted against the stopper heads 51*a* and 51*b* on the push rods 42*a*, 42*b* normally held in the open state by the difference in spring force in the above-described first embodiment, it is also possible to eliminate the stopper heads from the push rods as shown in FIG. 3. In FIG. 3, a push rod 73 normally closes an exhaust valve 74 on a valve seat 76 by a action of the spring 75. This arrangement has a feature of encouraging pressure draining action in a space 77. In this case, in order to form a small leaking gap between the exhaust valve 74, the push rod 73, and the valve seat 76, it is preferred to form the exhaust valve 74 of a resilient material to avoid occlusion of exhaust air in the space 77.

Further, instead of abutting one end of the bias springs 54*a* and 54*b* on the partition walls 50*a* and 50*b* of the push rod guides 49*a* and 49*b* as in the above-described first embodiment, they may be abutted on a seat member 78 which is formed on the push rod 73 as particularly shown in FIG. 3.

Moreover, it is possible to imbalance the spring forces of the travel springs 56*a*, 56*b* and the bias springs 54*a*, 54*b* in the foregoing embodiment. By doing so, the spool stalling in the neutral position can be prevented by the difference in spring force, in addition to an advantage that re-start of operation after a pause is facilitated all the more.

Figure 4:
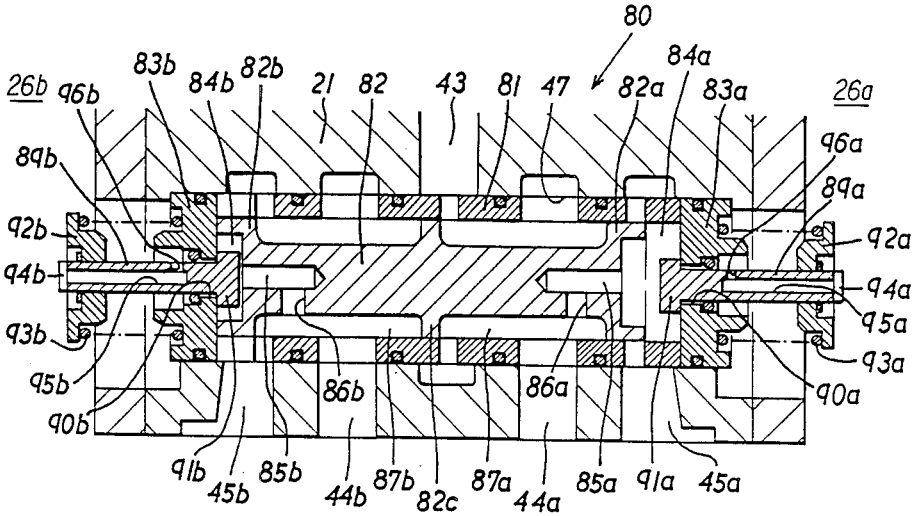
FIG. 4 is a schematic longitudinal section of a switch valve in another embodiment of the invention.

Illlustrated in FIG. 4 is a switch valve 80 of a modified construction, which is suitable for use in place of the switch valve 40 of the foregoing embodiment. As a stall preventing means, the switch valve 80 is arranged to apply the resisting force of the fluid pressure in the driving chamber to the spool, thereby restraining the switching pressure until the median point is reached and applying an increased output fluid pressure to the spool past the median point in a direction encouraging the spool drive.

More particularly, the switch valve 80 has a spool 82 slidably fitted in a sleeve 81 in the bore 47 in the central partition wall 21. The spool 82 is centrally provided with a land 82*c* for selectively communicating the supply port 43 with either one of the output ports 44*a* and to 44*b*. In addition, the spool 82 has lands 82*a* and 82*b*, which are formed at the opposite ends of the spool 82 for opening and closing the exhaust ports 45*a* and 45*b*, respectively. The end faces of the lands 82*a* and 82*b* form fluid receiving spaces 84*a* and 84*b* in cooperation with push rod guides 83*a* and 83*b*. These spaces 84*a* and 84*b* are communicable with chambers 87*a* and 87*b* formed between the lands 82*c* and 82*a* or 82*b* through axial bores 85*a* and 85*b* formed into the end faces of the spool 82 and radial passages 86*a* and 86*b*. The push rod guides 83*a* and 83*b* b which close the opposite ends of the sleeve 81 are hermetically fitted in the bore 47 in a manner similar to the sleeve 81. The push rod guides 83*a*, 83*b* are centrally provided with outwardly widened bores 90*a* and 90*b* for slidably receiving therein push rods 89*a* and 89*b*. The just-mentioned push rods 89*a* and 89*b* are hermetically fitted in the bores 90*a* and 90*b* through seal members.

The push rods 89*a* and 89*b* are formed with enlarged head portions 91*a* and 91*b* at the respective inner ends for closing the axial bores 85*a* and 85*b*. In this connection, the enlarged head portions 91*a* and 91*b* are not necessarily required to be able to close the axial bores 85*a*, 85*b* hermetically. Spring seats 92*a* and 92*b* are fixed on projected portions of the push rods 89*a* and 89*b*, which extend into the boosting chambers 26*a* and 26*b* through the push rod guides 83*a* and 93*b*. The push rods 89*a* and 89*b* are biased toward the boosting chambers 26*a*, 26*b* by springs 93*a* and 93*b* which are provided between the spring seat 92*a* and 92*b* and the push rod guide 83*a* or 83*b*.

Further, the push rods 89*a* and 89*b* are provided with axial bores 95*a* and 95*b* which extend axially from radial grooves 94*a* and 94*b* on the outer end faces of the respective push rods 89*a*, 89*b* communicating the axial bores 95*a* and 95*b* with radial passage 96*a* and the axial 96*b* on lateral sides of the push rods 89*a* and 89*b*.

The booster with the switch valve 80 operates in the manner as follows.

FIG. 4 illustrates the switch valve 80 in a position where the pressurized fluid is supplied to the drive chamber 27*b* from the output port 44*a*, feeding fluid of elevated pressure from the boosting chamber 26*b*. In this instance, the exhaust port 45*a* is closed by the land 82*a*, so that the pressurized air which flows into the space 84*a* from the chamber 87*a* through the opening 86*a* and bore 85*a* of the spool 82 acts on the spool 82 without flowing to the outside. The push on the spool 82 by the pressurized air in the space 84*a* continues until the spool 82 reaches its median position. The output port 44*b* is in communication with the exhaust port 45*b* through the chamber 87*b*, so that the drive chamber 27*a* is released to the atmosphere. By the pressurized air which flows into the drive chamber 27*b* from the output port 44*a*, the piston assembly 23 is moved rightward to intensify the air pressure in the boosting chamber 26*b*, feeding the intensified air pressure from the output port 32 through the outlet check valve 36*b*.

As the piston assembly is moved rightward, the piston 24*b* pushes the push rod 89*b* against the action of the spring 93*b*, moving the push rod 89*b* rightward to push the spool 82 substantially to its median position agains the biasing force of the fluid pressure in the space 84*a*, with the axial bore 85*b* of the spool 82 closed by the enlarged head portion 91*b*.

As soon as the spool 82 reaches approximately its neutral position, the opening 96*b* in the push rod 89*b* comes into communication with the space 84*b* past the seal member. Accordingly, the intensified pressure in the boosting chamber 26*b* is led into the space 84*b* through the radial groove 94*b*, the axial bore 95*b*, and the opening 86*b*, and superposed on the operating pressure of the piston 24*b* to move the spool 82 rightward in a secure manner, thereby switching the flow passages to supply the pressurized air from the supply port 43 to the output port 44*b*.

Further, when the spool 82 reaches approximately its neutral position, the land 82*a* uncovers the exhaust port 45*a* simultaneously with the above-mentioned flow of pressurized fluid into the space 84*b*. Consequently, the pressurized air in the drive chamber 27*b* is released into the atmosphere from the exhaust port 45*a* via the output port 44*a* and the chamber 87*a*, while air in the space 84*a* is also released into the atmosphere through the axial bore 85*a* and the radial passage 86*a* in the spool 82, without hindering the rightward movement of the spool 82.

Then, if the push rod 89*b* is freed of the piston pressure by reversal of the piston movement, it is returned spring 93*b*. As a result, the seal between the opening 96*b* and the enlarged head portion 91*b* blocks the spring 93*b*, and as a result the opening 96*b* blocks the communication between the boosting chamber 26*b* and the space 84*b*. On the other hand, the supply air flows into the space 84*b* through the radial passage 86*b* and the axile bore 85*b* to maintain the rightward movement of the spool 82.

The supply air which has flown into the chamber 87*b* from the supply port 42 as a result of the rightward movement of the spool is introduced into the drive chamber 27*a* through the output port 44*b* to move the piston assembly leftward until the spool returns to the position of FIG. 4 by the same sequence of operation as described above, repeating the operation thereafter to continue the boosting.

Figure 5:
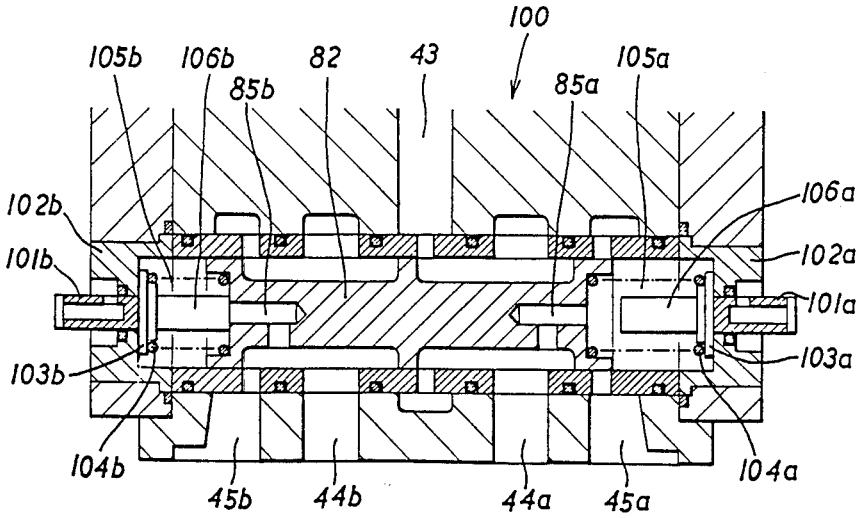
FIG. 5 is a view similar to FIG. 4 but showing a modified valve construction.

Illustrated in FIG. 5 is a modification of the above-described switch valve 80, in which the switch valve 100 is, like the switch valve in FIG. 4, provided with stoppers 103*a* and 103*b* on push rods 101*a* and 101*b* at the opposite ends of the spool 82. The stoppers 103*a*, 103*b* engage abuttingly with push rod guides 102*a* and 102*b*, respectively. and with springs 104*a* and 104*b* which are interposed between the spool 82 and the stoppers 103*a* and 103*b* in spaces 105*a* and 105*b* formed between the opposite ends of the spool 82 and the push rod guides 102*a* and 102*b*, omitting the spring seats 92*a* and 92*b* of the embodiment shown in FIG. 4. With this switch valve 100, the stoppers 103*a* and 103*b* prevent draw-off of the push rods 101*a* and 101*b*, so that there is no necessity for bulging out head portions 106*a* and 106*b* at the inner ends of the push rods 101*a* and 101*b* as long as they have a sufficient diameter for closing the axile bores 85*a* and 85*b* of the spool 82.

According to the above-described switch valve 100 in which the difference in stretching force between the springs 104*a* and 104*b* is imposed on the spool 82, it is possible to compact its construction as a whole and to shift the balancing position of the spool by employing springs 104*a* and 104*b* of different forces, for the purpose of effectively preventing spool stalls at the neutral position and facilitating its re-start.

Further, according to the switch valve 80 or 100, as the spool is switched not only by the pressing force of the booster pistons but also by the boosted fluid pressure which is applied to one end of the switch valve in superposition of the pressing force of the pistons, the spool operating force is augmented and the operation of the spool becomes secure. In addition, while the spool is slided with the aid of the fluid pressure acting on one end of the spool, the fluid pressure which acts on the opposite end of the spool does not hinder the sliding movement of the spool since it is released to the atmosphere through the exhaust port as soon as the neutral position is reached.

Even when the push rods of the switch valve are free of the pressing force of the pistons, the fluid pressure acts on either one of the end faces of the spool to retain the spool stably in the switched position. Accordingly, it is possible to prevent the spool stalling in the vicinity of the neutral position without restarting.

Figure 6:
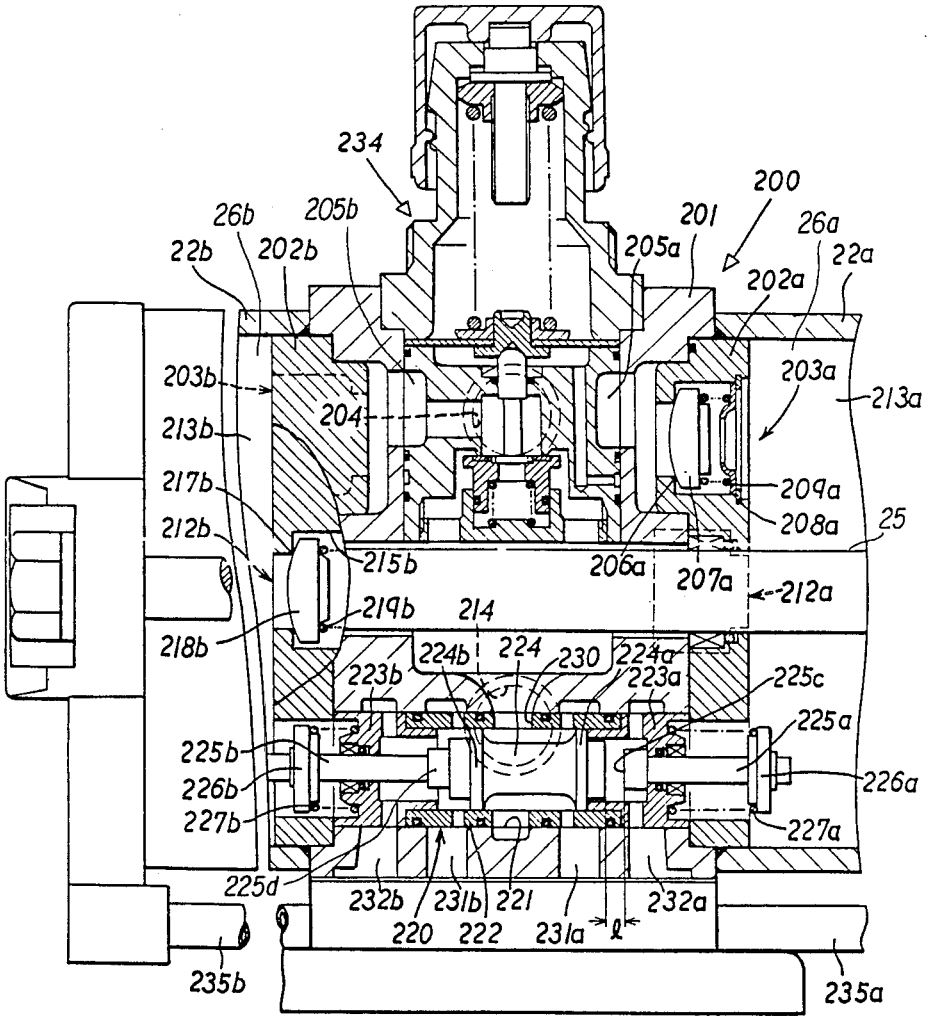
FIG. 6 is a vertically sectioned front view of a further embodiment of the invention.

FIG. 6 illustrates another embodiment of the booster, in which the switch valve employs a push rod spring as a stall preventing means for the push rod which project into a boosting chamber of the cylinder. The push rod spring, restrains the push rod from being driven to a neutral position against the pressing force of the piston when the supply fluid pressure to the drive chamber drops below a predetermined level. The push rod spring into combination with an inlet check valve spring provided for preventing reverse flows of fluid from the boosting chamber through the corresponding inlet check valve, which should permits only the fluid flows from the inlet port to the boosting chamber.

More particularly, in this embodiment, a central partition wall 200 of the booster casing is constituted by a main block 201 which is sandwiched between a pair of check valve casings 202*a* and 202*b*. Cylinder 22*a* and 22*b* are fit around the outer peripheries of the check valve casings 202*a* and 202*b* in a manner similar to the foregoing embodiments.

An inlet check valve 203*a* is provided in the check valve casing 202*a*. It includes a valve seat 206*a* opening into an inlet passage 205*a* in communication with the inlet port 204 in an unshown passage, and a valve body 207*a* for closing the valve seat 206*a*. The valve body 207*a* is biased toward the valve seat 206*a* by a check valve spring 209*a* which is retained by a snap ring 208*a* provided on the check valve casing 202*a*. The check valve spring 209*a* may be omitted for a cost reduction in some cases, but it is effective for securely closing the valve seat 206*a* even when the speed of the piston assembly is slowed down.

Although omitted from the illustration, the inlet check valve 203*b* provided in the check valve casing 202*b* has substantially the same construction as the above-described inlet check valve 203*a*.

An outlet check valve 212*b* provided in the check valve casing 202*b* includes an outlet check valve spring 219*b* for urging a valve body 218*b* toward a valve seat 217*b* in an outlet passage 215*b* which communicates a boosting chamber 213*b* with an outlet port 214.

Though not shown, an outlet check valve 212*a* which is provided in the check valve casing 202*a* has substantially the same construction as the above-described outlet check valve 212*b*.

On the other hand, the switch valve 220 which is built in the main block 201 is provided with a sleeve 222 fitted in a bore 221 intercommunicating boosting chambers 213*a* and 213*b* on the opposite sides of the main block 201 and sandwiched between the check valve casings 202*a* and 202*b* through push rod guides 223*a* and 223*b*. A spool 224 with lands 224*a* and 224*b* is received in the bore 221. Push rods 225*a* and 225*b* are axially slidable in the push rod guides 223*a*, 223*b* for pushing the spool 224. The push rods 225*a* and 225*b* have spring seats 226*a* and 226*b* fixed at their respective outer ends, and push rod springs 227*a* and 227*b* are compressed between the spring seats 226*a* and 226*b* and the push rod guides 223*a* and 223*b* to bias the push rods 225*a* and 225*b* constantly toward the boosting chambers 213*a* and 231*b* through openings provided in the check valve casings 202*a* and 202*b*.

The springs which are provided in the switch valves of FIGS. 2 to 5 for urging the push rods toward the boosting chambers serve to urge the push rods to protrude into the boosting chambers constantly, and accordingly they have a small strength which is sufficient for simply biasing the push rods. However, the above-mentioned push rod springs 227*a* and 227*b* have a greater strength in order to restrain the drive of the spool 224 to the neutral position against the pressing force of the pistons 24*a*, 24*b* when the supply fluid pressure to the drive chambers 27*a*, 27*b* drops as will be described hereinafter. If desired, the springs in the switch valves of FIGS. 2 to 5 may be arranged as in FIG. 6 to obtain similar functions.

The switch valve 220 includes a supply port 230 which is communicated with an inlet port 204 through a pressure regulator valve 234 having substantially the same construction as the counterpart in the embodiment of FIG. 2. Output ports 231*a* and 231*b* of the switch valve 220 are communicated with the respective drive chambers, not shown, through external conduits 235*a* and 235*b*, respectively. Exhaust ports 232*a* and 232*b* are opened to the atmosphere.

Provided between the end faces of the switch valve 220 and the end faces of the push rods 225*a* and 225*b*, which are urged toward the boosting chambers 213*a* and 213*b* by the push rod springs 227*a* and 227*b*, are gaps or push rod idling gaps 1 which permit the push rods 225*a* and 225*b* to contact the spool 224 only after a certain extent of displacement.

FIG. 6 shows the switch valve in a position in which the push rod 225*b* has slided across the idling gap 1 by rightward movement of the piston 24*b* (which is not shown) pushing the spool 224 rightward to switch the fluid pressure from the supply port 230 to the right drive chamber 27*a* through the output port 2321*a* and the external conduit 235*a*.

As the piston assembly is moved leftward from that position by the fluid pressure supplied to the drive chamber 27*a* and reaches almost its stroke end on the left-hand, the piston 24*a* gives a push to the push rod 225*a* against the biasing action of the push rod spring 227*a*, but the spool 224 remains in the position shown while the push rod 225*a* is sliding across the idling gap 1. If the piston 24*a* is moved leftward further, the push rod 225*a* comes into abutting engagement with the opposing end face of the spool 224 to move the spool 224 leftward, switching the supply fluid pressure from the supply port 230 from the outpupt port 231 to the output port 231 to move the pistons 24*a*, 24*b* rightward.

In the above-described operation, in case the line air pressure is gradually lowered to end a plant operation or for other reaons, the cycle of the piston reciprocation is slowed down accordingly, and the operating force of the pistons on the push rods is weakened, finally yielding to the biasing force of the push rod spring 227*a* or 227*b* which has a greater force at a stroke end. Therefore, the piston assembly is stopped while sliding the push rod 225*a* or 225*b* across the idling gap 1, without causing a sliding movement to the spool 224 of the switch valve 220.

In a case where the movement of the piston overcomes the biasing force of the push rod spring 227*a* or 227*b*, although its operating force is dropped, the push rod 225*a* or 225*b* may be pushed beyond the idling gap 1, reversing the drive chamber to charging or discharing state. On such an occasion, the piston assembly is moved to the position that the other piston is brought into abutting engagement with the other side push rod. However, intensified pressure is produced in the boosting chamber 213*a* or 213*b* by the sliding movement of the piston in the opposite direction, since the inlet check valve 203*a* or 203*b* is securely closed by the force of the inlet check valve spring 209*a* or 209*b* is stored at the counterward direction to the piston, so that the operating force of the piston is further balanced by means of these combined forces of the pressure and the spring, thereby to prevent the push rod 225*a* or 225*b* from acting on the spool 224 any longer by a sliding movement beyond the idling gap 1 as a result of the movement of the piston with reversed operating force. Even if the spool 224 is in a slightly slided position, the booster can be re-started easily as soon as the line air pressure is increased by initiation of the plant operation.

What is claimed is:

1. A fluid pressure booster comprising:

(a) a casing internally defining a pair of cylinders coaxially on opposite sides of a central partition wall having an inlet port, an outlet port, two exhaust ports, and two output ports;

(b) a piston assembly including a pair of pistons slidably fitted in said cylinders and a shaft connecting said pistons and hermetically passed through said central partition wall, said pistons defining boosting chambers on the sides of said central partition wall and drive chambers on the opposite sides of said central partition wall, respectively;

(c) inlet passages formed in said central partition wall for each one of said boosting chambers being in communication with said inlet port, and each one of said inlet passages having an inlet check valve permitting fluid flow only into said each boosting chamber (d) outlet passages formed in said central partition wall for each one of said boosting chambers being in communication with said outlet port, and each one of said outlet passages having an outlet check valve permitting fluid flow only out of said each boosting chamber;

(e) a switch valve comprising a valve body to be shifted between two positions by pressing push rods protruding into said boosting chambers from said central partition wall to communicate said drive chambers of said cylinders alternately with said inlet port and said exhaust port through outlet ports so as to drive said pistons toward the other stroke end upon reaching one stroke end thereof, and each protruding push rod being pushed by each piston when the piston closes to the central partition wall; and (f) passages connecting each one of said output ports in said central partition wall to a corresponding one of said drive chambers;

(g) a stall preventing means for discouraging said valve body from stopping at a neutral position between said two positions, CHARACTERIZED IN THAT said stall preventing means comprises;

(i) a pair of push rod springs each provided in association with said push rod protruding into said boosting chamber from said partition wall, said push rod springs preventing said valve body from being driven to the neutral position against the effort of said piston when the supply fluid pressure to said drive chamber drops below a predetermined level;

(ii) an idling gap provided between the inner end of each push rod and the opposite end face of said spool, permitting the inner end of said push rod to abut said end face of said valve body for driving said valve body when the pressing force of said piston based on the supply fluid pressure in said drive chamber reaches a predetermined pressing force; and (iii) an inlet check valve spring provided in each one of the inlet check valves and having a predetermined biasing force for closing the inlet check valve to prevent a reverse flow from the boosting chamber, (iv) whereby, when the valve body is positioned around the neutral position, said valve body is prevented from stopping at the neutral position, since said stall preventing means:

(A) restricts the valve body so as not to be pushed with the push rod by utilizing the biasing force of the spring until the valve body starts to move and (B) helps the sliding movement of the valve body once the valve body starts to move.

2. The fluid pressure booster as defined in claim 1, further comprising a pressure regulator valve provided in a conduit leading from said inlet port of said casing to said switch valve for regulating the fluid pressure to be supplied to said drive chamber.

3. A fluid booster comprising:

(a) a casing (20) internally defining a pair of cylinders (22a, 22b), said pair of cylinders (22a, 22b) being coaxial and on opposite sides of a central partition wall (200) having an inlet port (204), an outlet port (214), two exhaust ports (232a, 232b), and two output ports (231a, 231b);

(b) a piston assembly including a pair of pistons (24a, 24b), one of said pair of pistons (24a, 24b) being slidably fitted in each one of said pair of cylinders (22a, 22b), and a shaft (25) connecting said pair of pistons (24a, 24b), said shaft (25) being hermetically passed through said central partition wall (200), said pair of pistons (24a, 24b) defining a boosting chamber (26a, 26b) in each one of said pair of cylinders (22a, 22b) on the side of said central partition wall (200) and a drive chamber (27a, 27b) on the opposite side;

(c) an inlet passage (205a, 205b) formed in said central partition wall (200) for each one of said boosting chambers (26a, 26b) in communication with said inlet port (204), each one of said inlet passages (205a, 205b) being provided with an inlet check valve (207a, 207b) permitting fluid flow only in the direction toward the associated one of said boosting chambers (26a, 26b);

(d) an inlet passage formed in said casing (20) for each one of said boosting chambers (26a, 26b) in communication with said outlet port (214), each one of said outlet passages being provided with an outlet check valve (212a, 212b) permitting fluid flow only in the direction out of the associated one of said boosting chambers (26a, 26b);

(e) a fluid passageway (235a, 235b) connecting each one of said output ports (232a, 232b) in said central partition wall (200) to a corresponding one of said drive chambers (27a, 27b); and (f) a switch valve (220) comprising:

(i) a bore (221) extending through said central partition wall (200) from one of said boosting chambers (26a, 26b) to the other one of said boosting chambers (26a, 26b), said bore (221) being in fluid communication with said inlet port (204) and said outlet port (214), said bore (221) having an axially inwardly facing abutment surface adjacent each end thereof;

(ii) a sleeve (222) disposed in said bore (221); said sleeve (222) having a supply port (230) therethrough that is in fluid communication with said inlet port (204) and said outlet port (214) and, axially outwardly of said supply port (230), a pair of output ports, each one of said output ports being in fluid communication with a corresponding one of said output ports (231a, 231b) in said central partition wall (200);

(iii) a spool (224) slidably movable in said sleeve (222), said spool (224) having two axially spaced lands (224a, 224b) defining a central annular chamber that is in fluid communication with said supply port (230) in said sleeve (222) over the full range of travel of said spool (224) in said sleeve (222), said two axially spaced lands (224a, 224b) being axially spaced by a distance such that said central annular chamber is in fluid communication with one and only one of said pair of output ports in said sleeve (222) over the full range of travel of said spool (224) in said sleeve (222);

(iv) two push rod guides (223a, 223b) disposed in said bore (221), one of said push rod guides (223a, 223b) being located on each side of said sleeve (222), each one of said push rod guides (223a, 223b) abutting the adjacent end surface of said sleeve (222) and the adjacent one of said axially inwardly facing abutment surfaces in said bore (221), each one of said push rod guides (223a, 223b) having at least one radial opening that is in fluid communication with a corresponding one of said exhaust ports (232a, 232b), each one of said two push rod guides (223a, 223b) having an axially inner end sized, shaped, and positioned to make valving contact with the adjacent one of said two axially spaced lands (224a, 224b);

(v) a push rod (225a, 225b) slidably movable in each one of said push rod guides (223a, 223b), each one of said push rods (225a, 225b) having an axially inner head (225c, 225d) and an axially outer head (226a, 226b); and (vi) a travel spring (227a, 227b) disposed between each one of said push rod guides (223a, 223b) and the axially outer head (226a, 226b) of the corresponding one of said push rods (225a, 225b);

(viii) said push rods (225a, 225b), said axially inner heads (225c, 225d) and said spool (224) being sized and shaped so that:

(A) the axially outer end of each one of said push rods (225a, 225b) protrudes into the corresponding one of said booster chambers (26a, 26b) when neither of said pistons (24a, 24b) is in contact with the adjacent one of said push rods (225a, 225b);

(B) when one of said pistons (24a, 24b) contacts the axially outer end of the adjacent one of said push rods (225a, 225b), moving said push rod (225a, 225b) axially in the corresponding one of said push rod guides (223a, 223b) against the bias of the corresponding one of said travel springs (227a, 227b), the axially inner head (225c, 225d) of said push rod (225a, 225b) contacts said spool (224), moving said spool (224) axially and causing said two axially spaced lands (224a, 224b) on said spool (224) to block communication between said central annular chamber and one of said output ports in said sleeve (222) and to open communication between said central annular chamber and the other one of said output ports in said sleeve (222), whereby the pressure in said supply port (230) is shifted from a first one of said drive chambers (27a, 27b) to a second one of said drive chambers (27a, 27b) is placed in communication with the corresponding one of said exhaust ports (223a, 223b) and communication between the first one of said drive chambers (27a, 27b) and the corresponding one of said exhaust ports (232a, 232b) is blocked and the axially inner end of the other one of said push rod guides (223a, 223b) makes valving contact with the adjacent one of said two axially spaced lands (224a, 224b); and (C) when said spool (224) is in its neutral position, exhaust air from one of said output ports (231a, 231b) acts on the corresponding one of said two axially spaced lands (224a, 224b), thereby forcing said spool (224) beyond its neutral position and ensuring that the flow of fluid switches from one of said drive chambers (27*a*, 27*b*) to the other one of said drive chambers (27*a*, 27*b*) without stalling.

4. The fluid pressure booster as recited in claim 3 and further comprising a pressure regulator valve provided in a conduit leading from said inlet port (204) to said switch valve (220) for regulating the fluid pressure to be supplied to said boosting chambers (26*a*, 26*b*).

5. The fluid pressure booster as recited in claim 3 wherein said two axially spaced lands (224*a*, 224*b*) further define two axially outer annular chambers (57) between said spool (224) and a corresponding one of said two axially spaced lands (224*a*, 224*b*).

6. The fluid pressure booster as recited in claim 3 wherein:

(a) said central partition wall (200) comprises two axially spaced check valve casings (202*a*, 202*b*);

(b) each one of said inlet check valves (207*a*, 207*b*) is mounted in a corresponding one of said check valve casings (202*a*, 202*b*); and (c) each one of said axially inwardly facing abutment surfaces in said bore (221) is located on the axially inward surface of one of said check valve casings (202*a*, 202*b*).

7. The fluid pressure booster as recited in claim 3 wherein the axially outward end of each one of said push rods (225*a*, 225*b*) is axially outward of the axially outer head (226*a*, 226*b*) of the corresponding one of said push rods (225*a*, 225*b*).

* * * * *